US007180485B2

(12) United States Patent
Kimura et al.

(10) Patent No.: US 7,180,485 B2
(45) **Date of Patent: *Feb. 20, 2007**

(54) LIGHT EMITTING DEVICE

(75) Inventors: Hajime Kimura, Kanagawa (JP); Shunpei Yamazaki, Tokyo (JP)

(73) Assignee: Semiconductor Energy Laboratory Co., Ltd., Aisugi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/038,273

(22) Filed: Jan. 21, 2005

(65) Prior Publication Data

US 2005/0122283 A1 Jun. 9, 2005

Related U.S. Application Data

(63) Continuation of application No. 10/417,215, filed on Apr. 17, 2003, now Pat. No. 6,873,116.

(30) Foreign Application Priority Data

Apr. 26, 2002 (JP) ..... 2002-127703

(51) Int. Cl.
*G09G 3/36* (2006.01)

(52) U.S. Cl. ..... 345/76; 345/92; 315/169.3

(58) Field of Classification Search ..... 345/76, 345/92; 315/169.3
See application file for complete search history.

(56) References Cited

U.S. PATENT DOCUMENTS 5,793,163 A 8/1998 Okuda
5,898,328 A 4/1999 Shoji
6,724,359 B2 4/2004 Yamamoto et al.
6,873,116 B2 * 3/2005 Kimura et al. ..... 315/169.1
2001/0043113 A1 11/2001 Hoshino et al.
2002/0011981 A1 1/2002 Kuijk
2002/0089813 A1 7/2002 Yamamoto et al.
2002/0153844 A1 10/2002 Koyama

FOREIGN PATENT DOCUMENTS

EP 0 766 221 4/1997
EP 1 103 946 A2 5/2001
JP 09-097925 4/1997
JP 2001-5426 1/2001
JP 2001-343933 12/2001
JP 2002-277898 9/2002

* cited by examiner

*Primary Examiner*—David Vu
(74) *Attorney, Agent, or Firm*—Fish & Richardson, P.C.

(57) ABSTRACT

In order to suppress the influence of deterioration of a light emitting element resulting from a change over time, the present invention provides a light emitting device in which an electrical circuit for flowing a constant charge between both electrodes of the light emitting element is provided in each pixel. In addition, the present invention provides a light emitting device in which a transistor provided in each pixel is operated in a linear region and used as only a switch, so that the light emitting device is not influenced by a variation in characteristic of the transistor.

32 Claims, 9 Drawing Sheets

LIGHT EMITTING DEVICE

CROSS-REFERENCE TO RELATED APPLICATIONS

This application is a continuation application of U.S. application Ser. No. 10/417,215, filed Apr. 17, 2003, now U.S. Pat. No. 6,873,116, which claims the benefit of a foreign priority application filed in Japan as Serial No. 2002-127703 on Apr. 26, 2002. This application claims priority to each of these prior applications, and the disclosures of the prior applications are considered part of (and are incorporated by reference in) the disclosure of this application.

BACKGROUND OF THE INVENTION

1. Field of the Invention

The present invention relates to a technique for a light emitting device using a light emitting element, and more specifically to a technique for a light emitting device capable of supplying a predetermined charge to a light emitting element.

2. Description of the Related Art

In recent years, the development of a display device for displaying an image has been progressed. As the display device, a liquid crystal display device for displaying an image using a liquid crystal element has been widely used for a display screen of a mobile telephone by taking advantages of a high image quality, a thin type, a light weight, and the like.

On the other hand, in recent years, the development of a light emitting device using a light emitting element has been also progressed. The light emitting device has features such as a high response speed, superior moving picture display, and a wide viewing characteristic in addition to an advantage of an existing liquid crystal display device. Thus, it has been noted as a next-generation compact mobile flat panel display capable of using moving picture contents.

The light emitting element is made of a broad material such as an organic material, an inorganic material, a thin film material, a bulk material, or a dispersion material. Of them, as a typical light emitting element, there is an organic light emitting diode (OLED) mainly made of an organic material. The light emitting element has a structure in which an anode, a cathode, and a light emitting layer sandwiched between the anode and the cathode are provided. The light emitting layer is made of one or plural materials selected from the above-mentioned materials. Note that the amount of current flowing between both electrodes of the light emitting element and light emission intensity have a directly proportional relationship.

In many cases, a plurality of pixels each having a light emitting element and at least two transistors are provided in the light emitting device. In each of the pixels, a transistor connected in series with the light emitting element (hereinafter indicated as a driver transistor) has a function for controlling light emission of the light emitting element. When a gate-source voltage (hereinafter indicated as $V_{GS}$) of a driver transistor and a source-drain voltage (hereinafter indicated as $V_{DS}$) thereof are changed as appropriate, the driver transistor can be operated in mainly a linear region or in mainly a saturation region.

When the driver transistor is operated in mainly the linear region ($|V_{GS}-V_{th}|>|V_{DS}|$), the amount of current flowing between both electrodes of the light emitting element is changed according to both values of $|V_{GS}|$ and $|V_{DS}|$. Note that a drive method of operating the driver transistor in mainly the linear region is called constant voltage drive. FIG. 7B is a schematic view of a pixel to which the constant voltage drive is applied. In the constant voltage drive, the driver transistor is used as a switch, and a power source line and the light emitting element are shorted if necessary, thereby flowing a current into the light emitting element.

On the other hand, when the driver transistor is operated in mainly the saturation region ($|V_{GS}-V_{th}|<|V_{DS}|$), the amount of current flowing between both electrodes of the light emitting element is greatly dependent on a change in $|V_{GS}|$ of the driver transistor but not dependent on a change in $|V_{DS}|$. Note that a drive method of operating the driver transistor in mainly the saturation region is called constant current drive. FIG. 7A is a schematic view of a pixel to which the constant current drive is applied. In the constant current drive, a gate electrode of the driver transistor is controlled to flow the necessary amount of current into the light emitting element. In other words, the driver transistor is used as a voltage control current source and the driver transistor is set such that a constant current flows between a power source line and the light emitting element.

There is a light emitting device using a pixel including three transistors, a capacitor element, and a light emitting element and employing a time gradation method in addition to the above-mentioned constant voltage drive (see Patent References 1 and 2).

[Patent Reference 1] JP 2001-343933 A

[Patent Reference 2] JP 2001-5426 A

The light emitting device to which the above-mentioned constant voltage drive is applied is influenced by deterioration of the light emitting element resulting from a change over time. More specifically, when a voltage-current characteristic of the light emitting element is deteriorated due to a change over time, the amount of current flowing between both electrodes of the light emitting element becomes smaller, so that a desirable light emission intensity cannot be obtained.

On the other hand, according to the light emitting device to which the constant current drive is applied, a set current is supplied between both electrodes of the light emitting element. Thus, the influence of deterioration of the light emitting element resulting from a change over time can be suppressed. However, when characteristics such as mobility and a threshold value of the driver transistor are varied, there is caused a variation in the amount of current supplied to the light emitting element. In other words, a display screen is directly influenced by a variation in characteristic of the driver transistor. Thus, unevenness of the entire display screen is caused.

Also, in FIGS. 7A and 7B, in many cases, an n-channel transistor has been used as a switching TFT (thin film transistor), and a p-channel transistor has been used as the driver transistor from relation of source ground. Therefore, a complicated process in which transistors having different conductivity types are manufactured on an insulating surface or a semiconductor substrate causes a reduction in yield and a rise in cost.

SUMMARY OF THE INVENTION

The present invention has been made in view of the above problems, and has an object thereof to provide a light emitting device in which the influence of deterioration of a light emitting element resulting from a change over time is suppressed. In addition, another object of the present invention is to provide a light emitting device in which the influence of a variation in characteristics of a driver transistor is suppressed. Further, another of the present invention is to provide a light emitting device capable of simplifying a complicated manufacturing process resulting from manufacturing of transistors having different conductivity types on the same insulating surface.

According to the present invention, there is provided a light emitting device in which an electrical circuit for flowing a constant charge between both electrodes of a light emitting element is provided in each pixel in order to suppress the influence of deterioration of the light emitting element resulting from a change over time. In addition, according to the present invention, there is provided a light emitting device in which a transistor provided in each pixel is operated in a linear region and used as only a switch, so that a display screen is not influenced by a variation in characteristic of the transistor.

Further, according to the present invention, because the transistor provided in each pixel is used as a switch, its conductivity type is not particularly limited. Thus, each pixel can be composed of transistors with a single polarity, thereby reducing the number of manufacturing steps. As a result, a yield in the manufacturing process can be improved to reduce a manufacturing cost.

A brief summary of a pixel provided in the light emitting device of the present invention will be described with reference to FIG. 8A. In FIG. 8A, reference numerals 111 and 112 denote switches, 120 denotes a light emitting element, 121 denotes a signal line, 122 denotes a scanning line, 123 denotes a power source line, and a 125 denotes a charge pump (booster pump). A capacitor element provided in the charge pump 125 is connected in parallel with the light emitting element 120. Moreover, according to the present invention, using a switch provided in the charge pump 125, a constant charge is stored in the capacitor element and the stored charge is allowed to flow between both electrodes of the light emitting element 120.

A current-voltage characteristic of the light emitting element 120 is shown in FIG. 8B. From FIG. 8B, it is apparent that the amount of current flowing between both electrodes of the light emitting element 120 is controlled according to a voltage applied between both electrodes of the light emitting element 120. However, the amount of current flowing between both electrodes of the light emitting element 120 and the voltage applied therebetween have no proportional relationship.

Here, an enlarged graph of a region indicated by reference numeral 180 in FIG. 8B is shown in FIG. 8C. Thus, when the voltage applied to the light emitting element 120 is a constant voltage $V_{th}$ or less, a current hardly flows. When the voltage exceeds $V_{th}$, a current is started to increase in a substantially linear manner. In this specification, a voltage value at which a current value flowing between both electrodes of the light emitting element 120 is started to linearly increase is called a light emission start voltage $V_{th}$. In other words, when the applied voltage to the light emitting element 120 is increased to become the light emission start voltage (rising voltage) $V_{th}$ or higher, the light emitting element 120 starts to emit light.

According to the present invention, there is provided a light emitting device in which a plurality of pixels each having a capacitor element and a light emitting element are provided, including: means for supplying a charge to the capacitor element until a potential difference of the capacitor element becomes equal to a power source potential $V_{dd}$ (hereinafter indicated as first means); and means for supplying a charge to the light emitting element until the potential difference of the capacitor element becomes equal to a light emission start voltage $V_{th}$ of the light emitting element (hereinafter indicated as second means). In addition, according to the present invention, a proportional coefficient C of the capacitor element and a charge A flowing between both electrodes of the light emitting element satisfy $A=C\times(V_{dd}-V_{th})$.

According to the present invention, there is provided a light emitting device in which a plurality of pixels each having a charge pump provided with first and second capacitor elements and a light emitting element are provided, the charge pump including: means for supplying a charge to the first capacitor element until a potential difference of the first capacitor element becomes equal to a power source potential $V_{dd}$ (hereinafter indicated as third means); means for transferring a charge stored in the first capacitor element to the second capacitor element until a potential difference of the second capacitor element becomes equal to a sum of the power source potential $V_{dd}$ and a light emission start voltage $V_{th}$ of the light emitting element (hereinafter indicated as fourth means); and means for supplying a charge to the light emitting element until the potential difference of the second capacitor element becomes equal to the light emission start voltage $V_{th}$ of the light emitting element (hereinafter indicated as fifth means). In addition, a proportional coefficient $C_1$ and a potential difference $V_1$ of the first capacitor element, a proportional coefficient $C_2$ and a potential difference $V_2$ of the second capacitor element, and a charge A flowing between both electrodes of the light emitting element satisfy $A=C_2\times\{(2\times C_1\times V_{dd})/(C_1+C_2)-(C_1\times V_{th})/(C_1+C_2)\}$.

The first to fifth means correspond to a switch provided in a pixel, a driver circuit for controlling the switch, and a current supplying means for supplying a current to the pixel, and the like. In addition, it is characterized in that the pixel provided in the light emitting device of the present invention has a plurality of switches, and the plurality of switches are a plurality of transistors (or thin film transistors) each having a single polarity (single conductivity type).

DESCRIPTION OF THE PREFERRED EMBODIMENTS

[Embodiment 1]

Figure 1A:
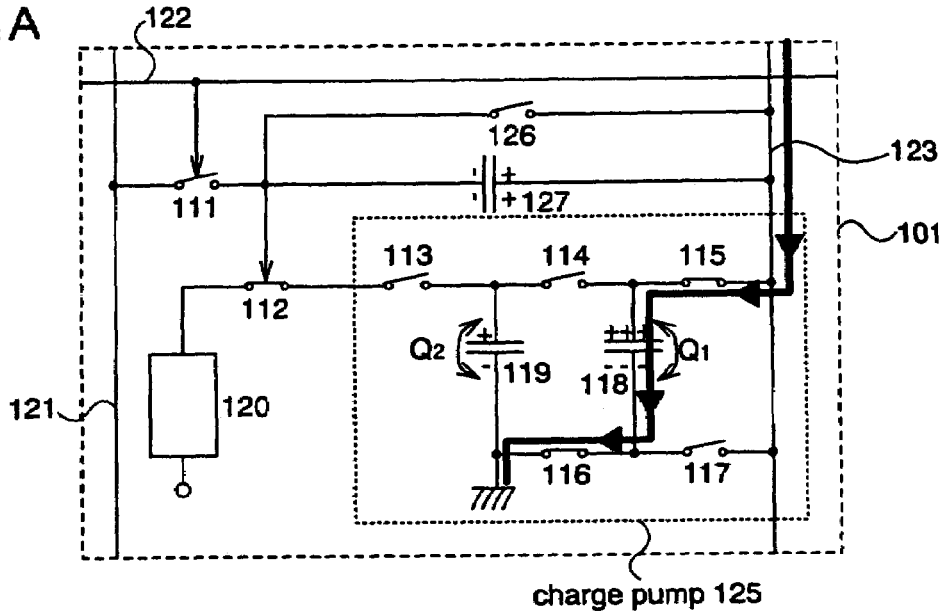
FIGS. 1A and 1B are explanatory diagrams each showing a configuration and operation of a pixel provided in a light emitting device of the present invention.

In this embodiment, a configuration and an operation of a pixel provided in a light emitting device of the present invention will be described with reference to FIG. 4B.

First, a detailed configuration of a pixel 101 in this embodiment will be described with reference to FIG. 4B. In the pixel 101, reference numerals 111 to 114 and 126 denote switches, 120 denotes a light emitting element, 121 denotes a signal line, 122 denotes a scanning line, 123 denotes a power source line, and 119, and 127 denote capacitor elements.

The switches 11 and 126 are connected in series and the switches 112 to 114 are connected in series with one another. In addition, the capacitor element 119 and the light emitting element 120 are connected in parallel. Note that elements each having a switching function are desirably used for the switches 111 to 114 and 126, preferably, transistors are used therefor. When transistors are used for the switches 111 to 114 and 126, it is necessary to provide a scanning line to each of the switches in order to input a signal for controlling an on or off of each of the switches. However, the scanning lines are omitted in FIG. 4B. Note that a diode or a transistor in which a gate and a drain are connected with each other may be used for the switches 113 and 114. In this embodiment, a potential of the power source line is taken as $V_{dd}$ and a light emission start voltage (threshold voltage) of the light emitting element 120 is taken as $V_{th}$. In the capacitor element 119, a charge, a proportional coefficient, and a potential difference are taken as $Q_3$, $C_3$, and $V_3$, respectively.

Figure 4A:
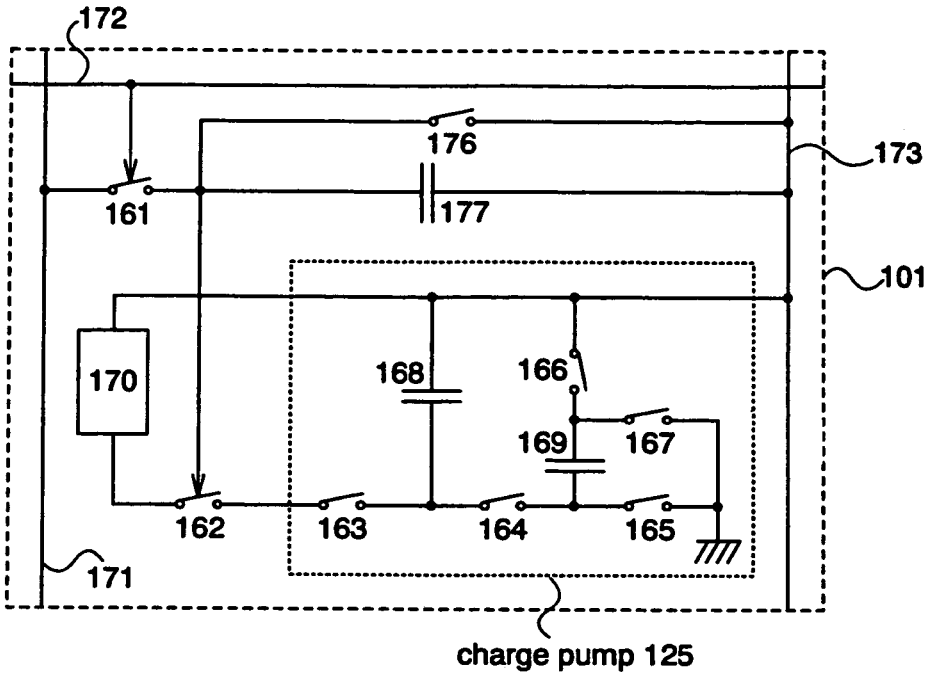
FIGS. 4A and 4B are diagrams showing configurations of a pixel provided in the light emitting device of the present invention.
Figure 4B:
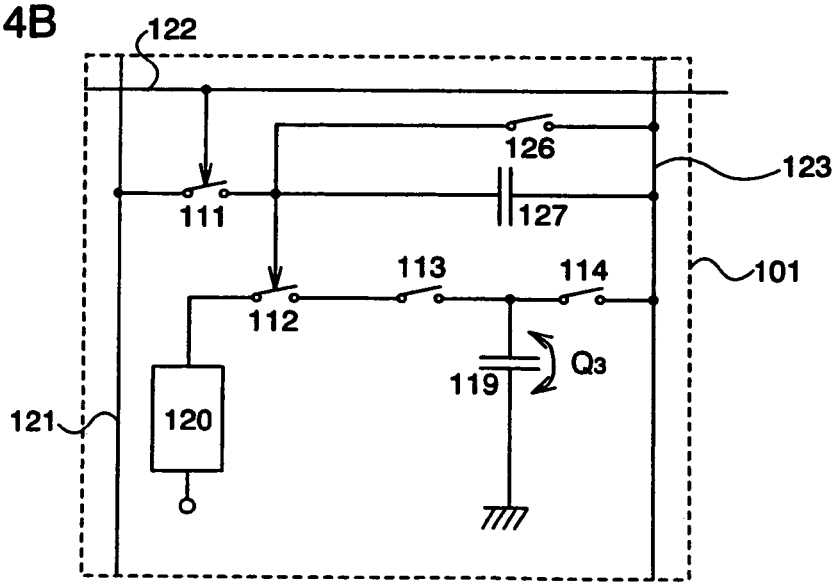

Note that, in the pixel 101 shown in FIG. 4B, the switch 111 controls the input of a video signal to the pixel 101. The switch 112 controls electrical connection or no electrical connection between the light emitting element 120 and the capacitor element 119. The capacitor element 127 stores the video signal to be inputted to the pixel 101. The switch 126 has a function of discharging a charge stored in the capacitor element 127 to turn off the switch 112, so that light emission of the light emitting element 120 is stopped. Because the more detailed description of a light emitting device in which three switches (transistors), a capacitor element, and a light emitting element are provided in each pixel is made in Patent Reference 1, it is preferably referred thereto. In addition, because operation of a light emitting device in the case where the switches 113 and 114 and the capacitor element 119 are omitted from each pixel 101 shown in FIGS. 1 and 2 is analogous to the operation of the light emitting device described in the above-mentioned patent reference, it is preferably referred thereto.

Next, the operation of the pixel 101 shown in FIG. 4B will be described.

First, when the switch 111 is turned on, a video signal inputted to the signal line 121 is inputted to the switch 112. Then, an on or off of the switch 112 is determined according to a potential of the video signal. Here, assume that the video signal by which the switch 112 is turned on is inputted to the pixel 101 and a predetermined charge by which the switch 112 is kept to an on state is stored in the capacitor element 127.

Note that light emission or non-light emission of the light emitting element 120 included in each pixel 101 is determined according to the video signal inputted to each pixel 101. More specifically, when the switch 112 is turned on according to the video signal to be inputted to each pixel 101, the light emitting element 120 emits light. In addition, when the switch 112 is turned off, the light emitting element 120 does not emit light.

In this state, the switch 114 is turned on and the switches 111, 113, and 126 are turned off. Then, a current flows from the power source line 123 to the capacitor element 119 through the switch 114. When the current flows, a potential difference starts to produce between both electrodes of the capacitor element 119 and a charge is gradually stored therein. The storage of the charge is continued until the potential difference between both electrodes of the capacitor element 119 becomes equal to the potential $V_{dd}$ of the power source line 123. Then, when the storage of the charge in the capacitor element 119 is completed, $Q_3$ satisfies the following equation (1), $$Q_3 = C_3 \times V_{dd} \quad (1).$$

Next, the switch 113 is turned on and the switches 111, 114, and 126 are turned off. Here, assume that the switch 112 is turned on in response to the video signal inputted to the pixel 101. Then, a current flows between both electrodes of the light emitting element 120 through the capacitor element 119 and the switches 113 and 112. At this time, the current flows between both electrodes of the light emitting element 120 until the potential difference of the capacitor element 119 becomes equal to the light emission start voltage of the light emitting element 120. In other words, a value obtained by subtracting the light emission start voltage of the light emitting element 120 from the potential difference of the capacitor element 119 as indicated by the equation (1) corresponds to a charge flowing into the light emitting element 120. When the charge is taken as A, the charge A satisfies the following equation (2), $$A = C_3 \times (V_{dd} - V_{th}) \quad (2).$$

Thus, when the constant charge A flows between both electrodes of the light emitting element 120, the switch 113 is turned off, the switch 114 is turned on, and the above-mentioned operation is repeated. Note that the operation is repeated during a predetermined period. The predetermined period corresponds to a period for which the switch 112 is turned on. In other words, the period corresponds to a period from the selection of the switch 126 to the discharge of the charge stored in the capacitor element 127.

As described above, according to the present invention, the circuit for flowing the constant charge between both electrodes of the light emitting element is provided in each pixel. Thus, the influence of deterioration of the light emitting element resulting from a change over time can be suppressed. In addition, according to the present invention, the transistor provided in each pixel is operated in a linear region and used as only a switch. Thus, the influence of a variation in characteristic of the transistor can be suppressed. Further, according to the present invention, because the transistor provided in each pixel is used as a switch, its conductivity type is not particularly limited. Therefore, each pixel can be composed of transistors with a single polarity, thereby reducing the number of manufacturing steps. As a result, a yield in the manufacturing process can be improved and a manufacturing cost can be reduced.

[Embodiment 2]

In this embodiment, a detailed configuration and an operation of a pixel provided in a light emitting device of the present invention will be described with reference to FIGS. 1A, 1B, 2A, and 2B.

First, a detailed configuration of a pixel 101 in this embodiment will be described with reference to FIG. 1A. In the pixel 101, reference numerals 111, 112, and 126 denote switches, 120 denotes a light emitting element, 121 denotes a signal line, 122 denotes a scanning line, 123 denotes a power source line, 125 denotes a charge pump (booster pump), and 127 denotes a capacitor element. The charge pump 125 includes switches 113 to 117 and capacitor elements 118 and 119.

The switches 111 and 126 are connected in series, the switches 112 to 115 are connected in series, and the switches 116 and 117 are connected in series with each one another. In addition, the capacitor elements 118 and 119 are connected in parallel. Note that elements each having a switching function are desirably used for the switches 111 to 117 and 126, preferably, transistors are used therefor. When transistors are used for the switches 113 to 117 and 126, a conductivity type thereof is not particularly limited. Further, it is necessary to provide a scanning line to each of the switches in order to input a signal for controlling an on or off of each of the switches. However, the scanning lines are omitted in FIGS. 1A and 1B and FIGS. 2A and 2B. Note that a diode or a transistor in which a gate and a drain are connected with each other may be used for the switches 113 to 117 that the charge pump 125 has. In this embodiment, in the capacitor element 118, a charge and a proportional coefficient are taken as $Q_1$ and $C_1$, and in the capacitor element 119, a charge and a proportional coefficient are taken as $Q_2$ and $C_2$, respectively. Further, a potential of the power source line is taken as $V_{dd}$ and a light emission start voltage of the light emitting element 120 is taken as $V_{th}$.

Next, the operation of the pixel 101 provided in the light emitting device of the present invention will be described with reference to FIGS. 1A and 1B and FIGS. 2A and 2B.

First, when the switch 111 is turned on, a video signal inputted to the signal line 121 is inputted to the switch 112. Then, an on or off of the switch 112 is determined according to a potential of the video signal. Here, assume that the video signal by which the switch 112 is turned on is inputted to the pixel 101 and a predetermined charge by which the switch 112 is kept to an on state is stored in the capacitor element 127.

In this state, it is assumed that the light emission start voltage of the light emitting element 120 is stored in the capacitor element 119. Then, as shown in FIG. 1A, in the charge pump 125, the switches 115 and 116 are turned on and the rest of the switches are turned off. Then, a current flows from the power source line 123 to the switch 116 through the switch 115 and the capacitor element 119. When the current flows, a potential difference starts to produce between both electrodes of the capacitor element 118 and a charge is gradually stored therein. The storage of the charge is continued until the potential difference between both electrodes of the capacitor element 118 becomes equal to the potential $V_{dd}$ of the power source line 123. Then, when the storage of the charge in the capacitor element 118 is completed, $Q_1$ and $Q_2$ satisfy the following equations (3) and (4), $$Q_1=C_1\times V_{dd} \quad (3).$$

$$Q_2=C_2\times V_{dd} \quad (4).$$

Figure 1B:
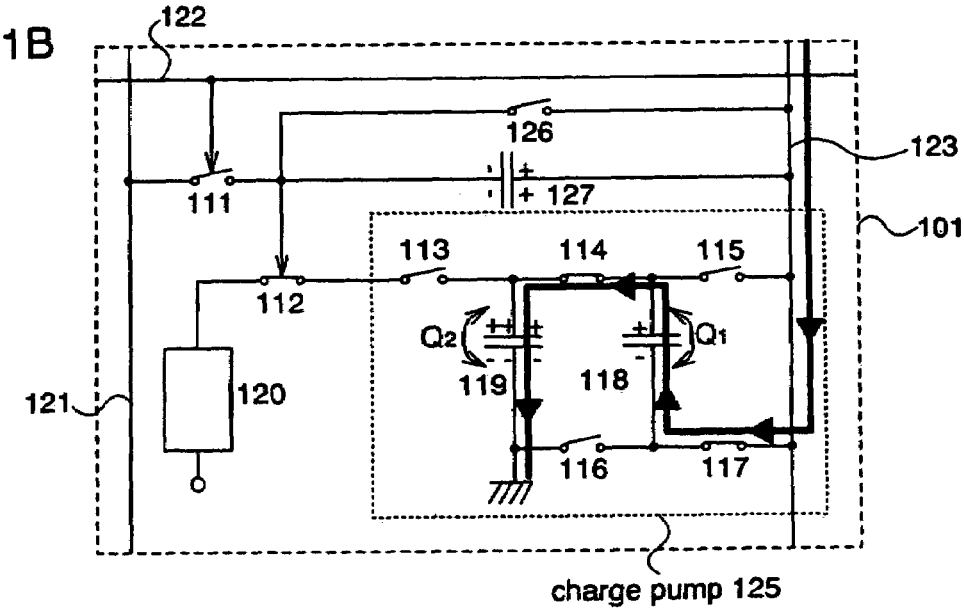

Next, as shown in FIG. 1B, in the charge pump 125, the switches 114 and 117 are turned on and the other switches are turned off. Then, a current flows from the power source line 123 to the capacitor element 119 through the switch 117, the capacitor element 118, and the switch 114. When the current flows, the charge stored in the capacitor element 118 is transferred to the capacitor element 119. When the transferred charge, the potential difference of the capacitor element 118, and the potential difference of the capacitor element 119 are taken as $\Delta Q$, $V_1$, and $V_2$, respectively, the following equations (5) and (6) hold. That is, $$-(Q_1-\Delta Q)=C_1\times V_1 \quad (5),$$

$$Q_2+\Delta Q=C_2\times V_2 \quad (6).$$

Because an added value of the potential differences $V_1$ and $V_2$ between both electrodes of each of the capacitor elements 118 and 119 is equal to the potential of the power source line 123, the following equation (7) holds. That is, $$V_{dd}=V_1+V_2 \quad (7)$$

Thus, from the above-mentioned equations (3) to (7), the potential difference $V_2$ of the capacitor element 119 can be obtained as indicated by the following equation (8).

$$V_2=(C_2\times V_{th})/(C_1+C_2)+(2\times C_1\times V_{dd})/(C_1+C_2) \quad (8)$$

Figure 2A:
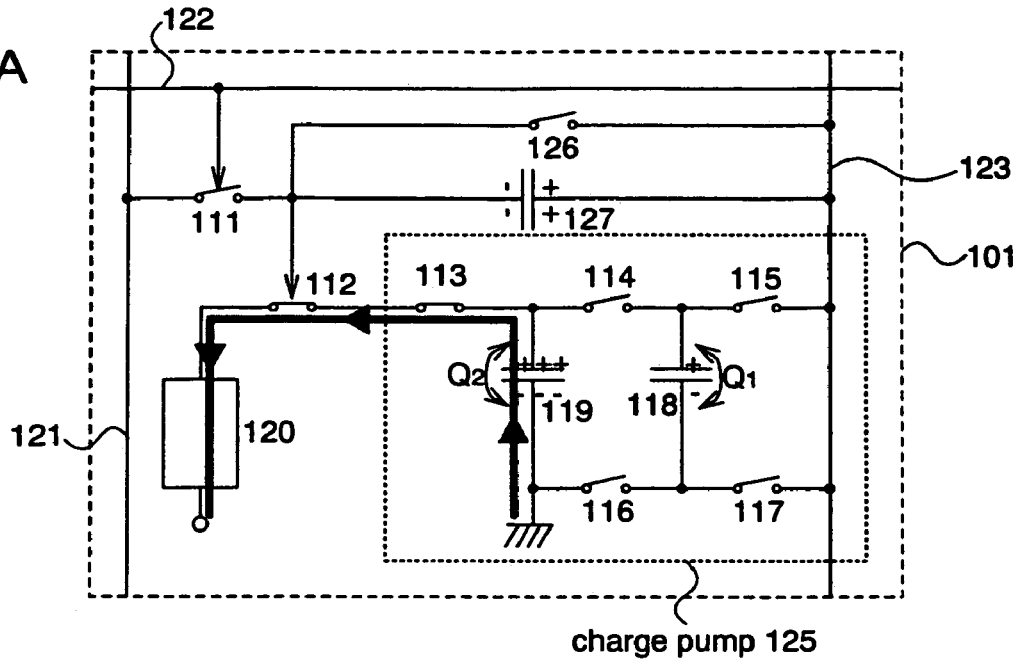
FIGS. 2A and 2B are explanatory diagrams each showing the configuration and operation of the pixel provided in the light emitting device of the present invention.

Next, as shown in FIG. 2A, in the charge pump 125, the switch 113 is turned on and the rest of the switches are turned off. Here, the switch 112 is turned on in response to the video signal inputted to the pixel 101. Then, a current flows between both electrodes of the light emitting element 120 through the capacitor element 119 and the switches 113 and 112. At this time, the current flows between both electrodes of the light emitting element 120 until the potential difference of the capacitor element 119 becomes equal to the light emission start voltage of the light emitting element 120. In other words, a value obtained by subtracting the light emission start voltage of the light emitting element 120 from the potential difference of the capacitor element 119 as indicated by the equation (8) corresponds to a charge flowing into the light emitting element 120. When the charge is taken as A, the charge A satisfies the following equation (9), $$A=C_2\times\{(2\times C_1\times V_{dd})/(C_1+C_2)-(C_1\times V_{th})/(C_1+C_2)\} \quad (9).$$

Figure 2B:
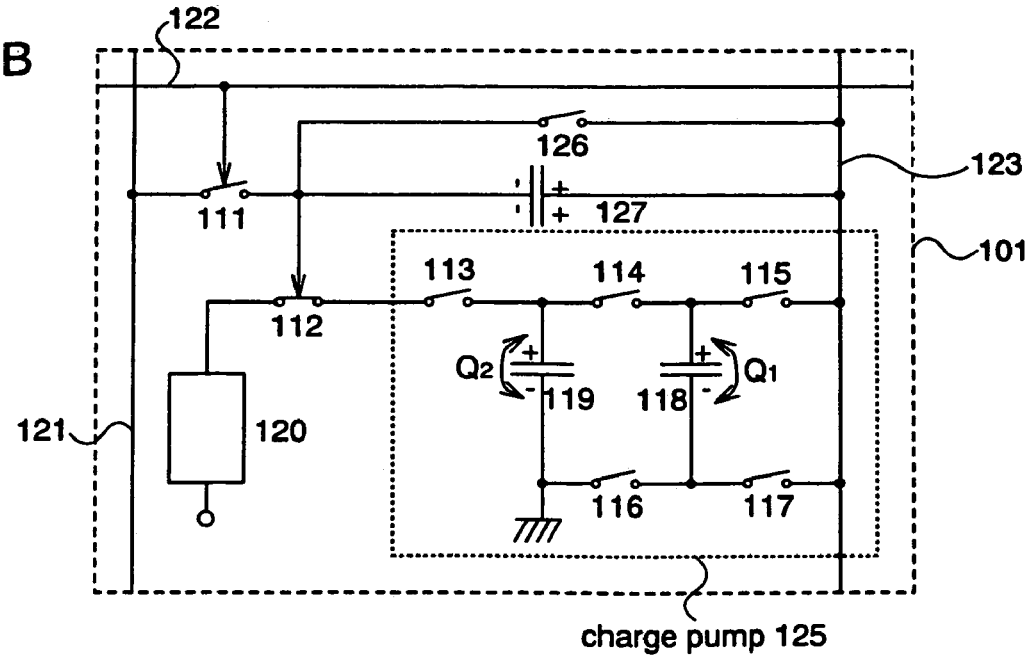

Subsequently, when the constant charge A flows between both electrodes of the light emitting element 120, the switch 113 is turned off as shown in FIG. 2B. At this time, the switches except the switch 112 are also kept to an off state. Thus, after the state shown in FIG. 2B is obtained, the state is returned to the state shown in FIG. 1A again and the above-mentioned operation is repeated.

Note that the operation from FIG. 1A to FIG. 2B is repeated during a predetermined period. The predetermined period corresponds to a period for which the switch 112 is turned on. In other words, the period corresponds to a period from the selection of the switch 126 to the discharge of the charge stored in the capacitor element 127. For example, in a light emitting device to which a time gradation method is applied, the period corresponds to a sub-frame period.

As described above, according to the present invention, the charge pump for flowing the constant charge between both electrodes of the light emitting element is provided in each pixel. Thus, the influence of deterioration of the light emitting element resulting from a change over time can be suppressed. In addition, according to the present invention, the transistor provided in each pixel is operated in a linear region and used as only a switch. Thus, the influence of a variation in characteristic of the transistor can be suppressed.

Further, according to the present invention, because the transistor provided in each pixel is used as a switch, its conductivity type is not particularly limited. Therefore, each pixel can be composed of transistors with a single polarity, thereby reducing the number of manufacturing steps. As a result, a yield in the manufacturing process can be improved and a manufacturing cost can be reduced.

Note that the above-mentioned configuration of the charge pump 125 is one embodiment. Thus, the present invention is not limited to this. A charge pump having any known configuration can be applied to the light emitting device of the present invention.

[Embodiment 3]

In this embodiment, a configuration of a pixel 101 which is different from that in the above-mentioned embodiment will be described with reference to FIGS. 3A, 3B, and 4A.

Figure 3A:
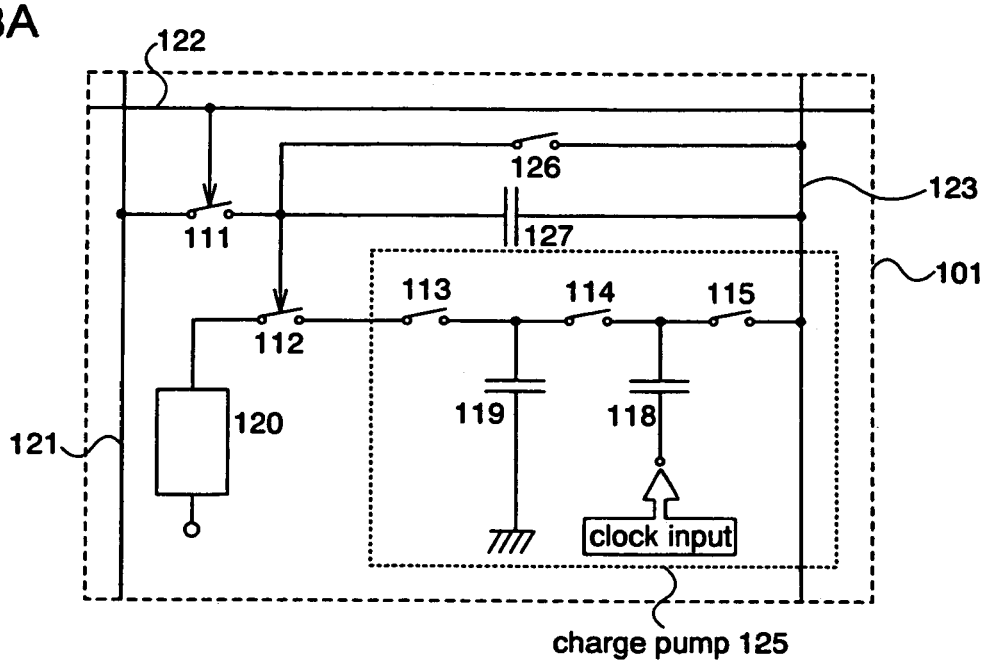
FIGS. 3A and 3B are diagrams showing configurations of a pixel provided in the light emitting device of the present invention.

The pixel 101 shown in FIG. 3A has a configuration in which the switches 116 and 117 are excluded in the pixel 101 shown in FIGS. 1A, 1B, 2A, and 2B. In addition, a clock signal is directly inputted to one electrode of the capacitor element 118. Because the detailed description for the configuration and operation of the pixel 101 shown in FIG. 3A is analogous to the above-mentioned embodiment, the description is omitted here.

Figure 3B:
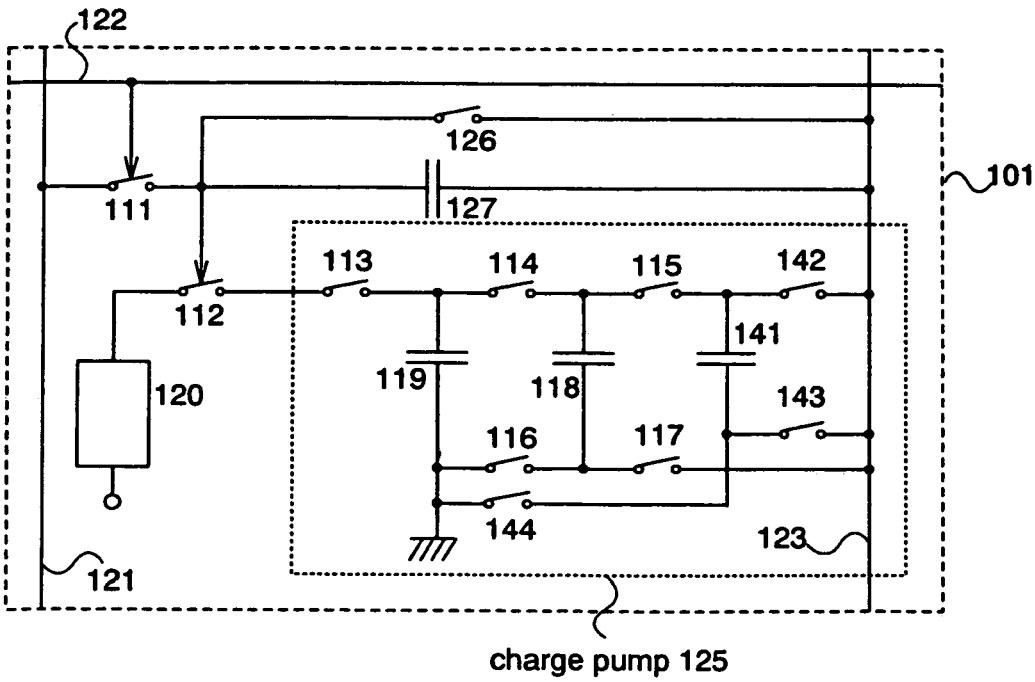

According to the configuration of the pixel 101 shown in FIG. 3B, a capacitor element 141 and switches 142 to 144 are added to the pixel 101 shown in FIGS. 1A, 1B, 2A, and 2B, thereby increasing the number of stages in a charge pump 125 by one stage to three stages. In the pixel 101, a charge A flowing into the light emitting element 120 can be indicated by the following equation (10), $$A=C_2\times\{(3\times C_1\times V_{dd})/(C_1+C_2)-(C_1\times V_{th})/(C_1+C_2)\} \quad (10).$$

In the above-mentioned equation (10), the coefficient of a term of $V_{dd}$ becomes 3. Thus, the dependency of a term of $V_{th}$ on the charge A becomes smaller. When the dependency of the term of $V_{th}$ on the charge A becomes smaller, the dependency on the light emission start voltage $V_{th}$ of the light emitting element 120 becomes smaller. Therefore, the influence of deterioration of the light emitting element 120 resulting from a change over time can be further suppressed. Note that, because the detailed description for the configuration and operation of the pixel 101 shown in FIG. 3B is analogous to the above-mentioned embodiment, the description is omitted here.

In the pixel 101 shown in FIG. 4A, reference numerals 161, 162, and 176 denote switches, 170 denotes a light emitting element, 171 denotes a signal line, 172 denotes a scanning line, 173 denotes a power source line, 125 denotes the charge pump (booster pump), and 177 denotes a capacitor element. The charge pump 125 includes switches 163 to 167 and capacitor elements 168 and 169. Because the detailed description for the operation of the pixel 101 shown in FIG. 4A is analogous to the above-mentioned embodiment, the description is omitted here.

Note that, in this embodiment, the pixel 101 including the two-stage charge pump 125 is shown in FIG. 3A and the pixel 101 including the three-stage charge pump 125 is shown in FIG. 3B. However, the present invention is not limited to these. The number of stages in the charge pump. 125 included in the pixel 101 is not particularly limited.

[Embodiment 4]

In this embodiment, an example in which the pixel 101 shown in FIG. 1A is actually laid out will be described with reference to FIG. 9.

Figure 9:
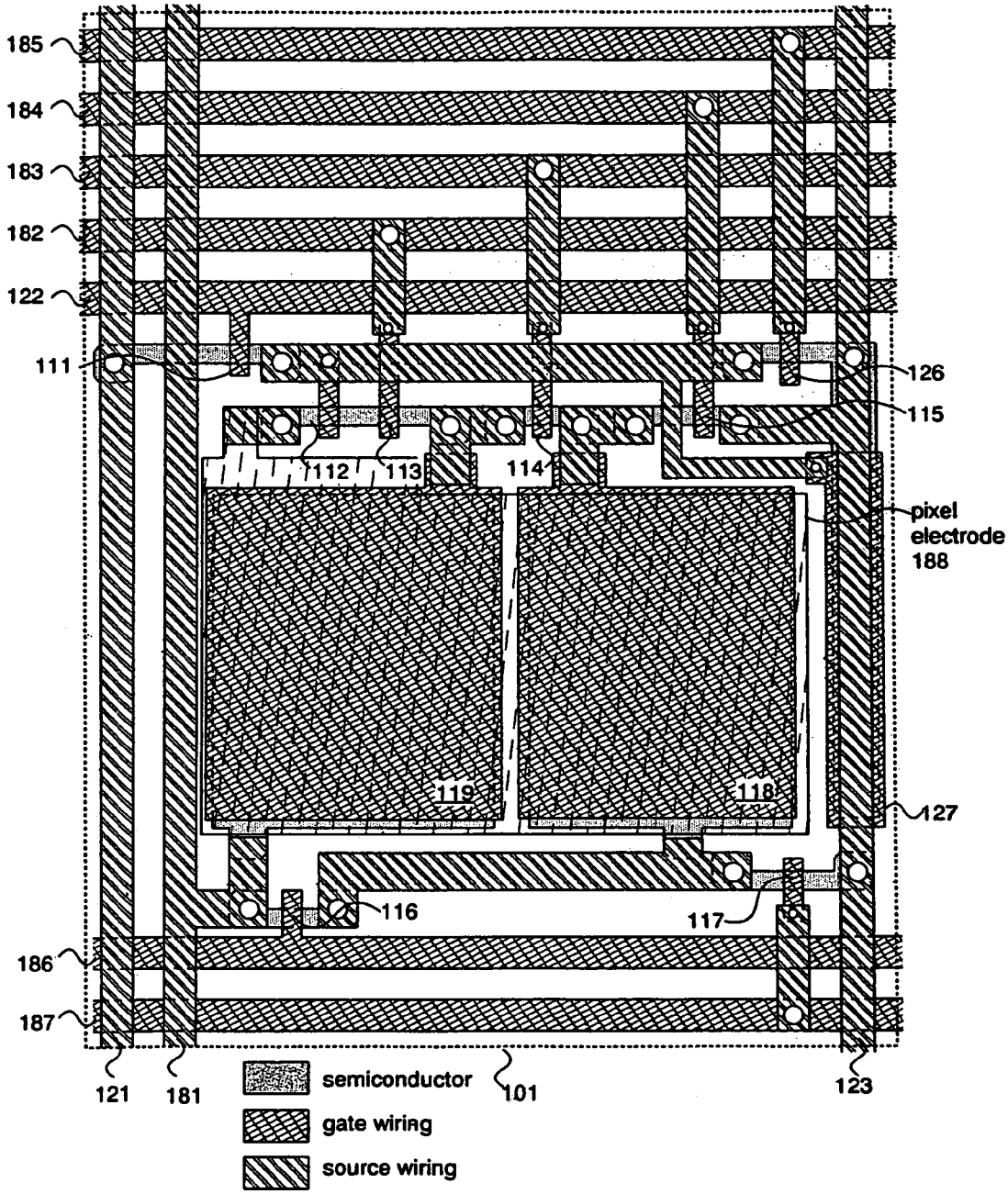
FIG. 9 is a layout diagram of the pixel provided in the light emitting device of the present invention.

In FIG. 9, reference numerals 111 to 117 and 126 denote transistors which are used as switches. Reference numerals 122 and 182 to 187 denote scanning lines, 121 denotes a signal line, 123 denotes a power source line, and 181 denotes a ground line. Reference numerals 118, 119, and 127 denote capacitor elements for which capacitors between a semiconductor and gate wirings are used. Reference numeral 188 denotes a pixel electrode. A light emitting layer and a counter electrode are laminated on the pixel electrode 188. However, the light emitting layer and the counter electrode are omitted in FIG. 9.

One of the source region and the drain region in the transistor 111 is connected with one electrode of the light emitting element 120 (not shown). In this embodiment, light emitted to the light emitting element 120 is exited from an opposite side surface to a substrate. When the number of elements provided in the pixel 101 is large as shown in FIG. 1A, it is preferable that light emitted to the light emitting element 120 is exited from an opposite side surface to a substrate.

Also, in the present invention, the total amount of charge which can be stored in the capacitor elements 118 and 119 becomes important. In the pixel 101 shown in FIG. 9, occupying areas of the capacitor elements 118 and 119 to the pixel 101 are the same degree. However, the present invention is not limited to this. An occupying area of each of the capacitor elements to the pixel 101 is particularly not limited.

[Embodiment 5]

In this embodiment, a drive method applied to the light emitting device of the present invention will be briefly described.

A drive method in the case where a multi-gradation image is displayed, is broadly divided into an analog gradation method and a digital gradation method. Both methods can be applied to the light emitting device of the present invention. A differential point between both methods is a method of controlling a light emitting element in respective states of light emission and non-light emission of the light emitting element. The former analog gradation method is a method of controlling the amount of current flowing into the light emitting element to obtain gradation. The latter digital gradation method is a method of driving the light emitting element with only two states of an on state (state in which an intensity is substantially 100%) and an off state (state in which an intensity is substantially 0%).

With respect to the digital gradation method, a combination method of a digital gradation method and an area gradation method (hereinafter indicated as an area gradation method) and a combination method of a digital gradation method and a time gradation method (hereinafter indicated as a time gradation method) have been proposed in order to represent a multi-gradation image.

The area gradation method is a method of dividing a pixel into a plurality of sub-pixels and selecting light emission or non-light emission for the respective sub-pixels to represent gradation according to a difference between a light emitting area and the other area in a pixel. In addition, the time gradation method is a method of controlling a period for which a light emitting element emits light to represent gradation as reported in Patent Reference 2. Specifically, a frame period is divided into a plurality of sub-frame periods having different lengths and light emission or non-light emission of the light emitting element is selected for each of the periods to represent gradation according to a length of a light emitting period during the frame period.

Both the analog gradation method and the digital gradation method can be applied to the light emitting device of the present invention. Note that, when the analog gradation method is applied, it is required that a plurality of power source lines with different potentials be provided in each of pixels or a potential of the power source line be changed according to a signal inputted to each of the pixels. On the other hand, when the digital gradation method is applied, all the power source lines in the respective pixels may be set to the same potential. Thus, the power source line can be commonly used between adjacent pixels.

Also, when the analog gradation method is applied and a plurality (here, n is assumed and n is a natural number) of power source lines with different potentials are provided in each of pixels, a plurality (preferably, n equal to the number of power source lines) of charge pump are preferably located in one pixel according to the number of power source lines. In addition, each of the power source lines with different potentials is made corresponding to each of the charge pumps located in the one pixel. Each of the charge pumps has means for supplying a charge to a light emitting element. Thus, a plurality of charge supplying means are necessarily provided in the one pixel and different charges are supplied from the respective means. When the sum of charges supplied from the respective means is supplied to the light emitting element, gradation display according to a video signal can be conducted. On the other hand, when a potential of the power source line is changed according to a signal inputted to each of the pixels, a charge supplied from the charge supplying means included in a charge pump located in each of the pixels is changed to conduct gradation display according to a video signal.

Note that, in a light emitting device for conducting multi-color display, a plurality of sub-pixels corresponding to respective colors of R, G, and B are provided in a pixel. With respect to the respective sub-pixels, because of a difference of current densities of respective materials for R, G, and B and a difference of transmittance of color filters therefor, there is the case where intensities of light emitted therefrom are different even when the same voltage is applied. Therefore, it is preferable that the potential of the power source line is changed for each of sub-pixels corresponding to the respective colors.

This embodiment can be arbitrarily combined with Embodiments 1 to 3.

[Embodiment 6]

Figure 5A:
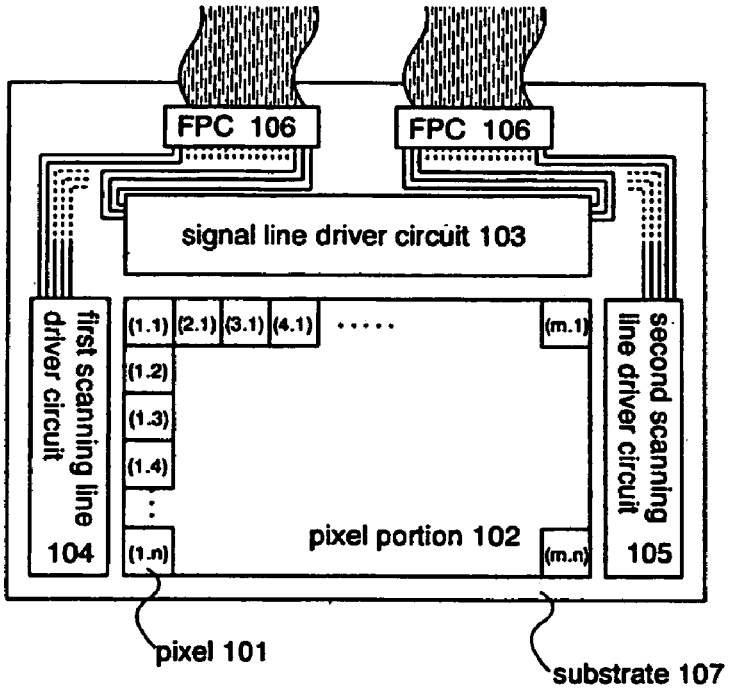
FIGS. 5A to 5C are diagrams showing the light emitting device of the present invention.
Figure 5B:
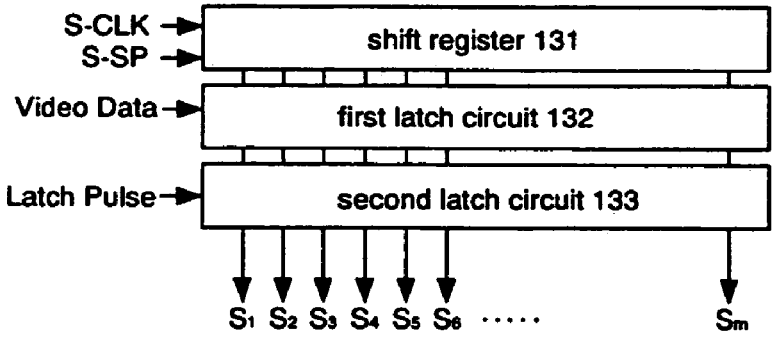
Figure 5C:
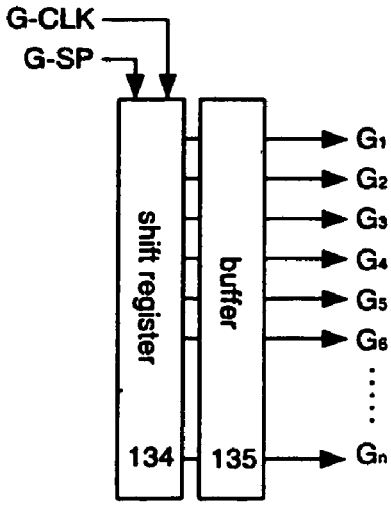

In this embodiment, a light emitting device of the present invention will be schematically describe with reference to FIGS. 5A to 5C.

A shown in FIG. 5A, the light emitting device of the present invention includes a pixel portion 102 having a plurality of pixels 101 arranged in matrix on a substrate 107. A signal line driver circuit 103, a first scanning line driver circuit 104, and a second scanning line driver circuit 105 are formed in the periphery of the pixel portion 102. Signals are supplied from the outside to the signal line driver circuit 103, the first scanning line driver circuit 104 and the second scanning line driver circuit 105 via FPCs 106.

Although the signal line driver circuits 103 and the two scanning line driver circuits 104 and 105 are provided in FIG. 5A, the present invention is not limited thereto, and may be arbitrary designed depending on the structure of the pixels 101. Further, although the driver circuits formed on the periphery of the pixel portion 102 are integrally formed on the same substrate, the present invention is not limited to this configuration. The driver circuits may be formed outside of the substrate 107 on which the pixel portion 102 is formed.

Note that the light emitting device in this specification indicates a category including a light emitting panel which a pixel portion having alight emitting element and a driver circuit are implanted between a substrate and a cover member, a light emitting module which an IC etc. is equipped with the light emitting panel, a light emitting display used as a display device. That is, the light emitting device corresponds to a generic name of the light emitting device, the light emitting module, the light emitting display and the like.

Next, a signal line driver circuit 103 provided in the light emitting device of the invention will be described with reference to FIG. 5B. The signal line driver circuit 103 includes a sift register 131 and first and second latch circuits 132 and 133. Operations will be briefly described as below: the sift register 131 is configurated by using a plurality of rows such as a flip flop circuit (FF); thereafter, a clock signal (S-CLK), a start pulse (S-SP) and a clock inverted signal (S-CLK) are inputted in the shift register 131; and sampling pulses are sequentially outputted in accordance with the timing of these signals.

Sampling pulses outputted from the shift register 131 are inputted in the first latch circuit 132. Further, a digital video signal is inputted in the first latch circuit 132, and the digital video signal is retained in the respective rows in accordance with the timing of inputting the sampling pulses.

In the first latch circuit 132, when the video-signal retaining operations are completed up to a final column, a latch pulse is inputted to the second latch circuit 133 during a horizontal retrace period. Thus, the video signal which was retained in the first latch circuit 132 is transferred simultaneously to the second latch circuit 133. Thereafter, the video signal retained in the second latch circuit 133 is inputted, simultaneously in an amount of one row, to signal lines $S_1$ to $S_m$.

While the video signal retained in the second latch circuit 133 is inputted in the signal lines $S_1$ to $S_m$, the shift register 131 again outputs a sampling pulse. Hereinafter, the operation is repeated.

Next, first and second scanning line driver circuits 104 and 105 will be described with reference to FIG. 5C. The first and second scanning line driver circuits 104 and 105 include a shift register 134 and buffer 135, respectively. Operations will be briefly described as below: the sift register 134 sequentially outputs sampling pulses in accordance with a clock signal (G-CLK), a start pulses (G-SP) and a clock inverted signal (G-CLKb); thereafter, the sampling pulses amplified in the buffer 135 are inputted in scanning lines; and the scanning lines are set to be in a selected state for each line.

Note that a level sifter may be disposed between the shift register 134 and the buffer 135. By arranging the level sifter, the voltage amplitude of a logic circuit portion and a buffer portion can be changed.

This embodiment can be arbitrary combined with Embodiments 1 to 4.

[Embodiment 7]

Electronic devices using a driving method of the display device of the present invention include a video camera, a digital camera, a goggles-type display (head mount display), a navigation system, a sound reproduction device (such as a car audio equipment and an audio set), a lap-top computer, a game machine, a portable information terminal (such as a mobile computer, a mobile telephone, a portable game machine, and an electronic book), an image reproduction apparatus including a recording medium (more specifically, an apparatus which can reproduce a recording medium such as a digital versatile disc (DVD) and so forth, and includes a display for displaying the reproduced image), or the like. FIGS. 6A to 6H respectively shows various specific examples of such electronic devices.

Figure 6A:
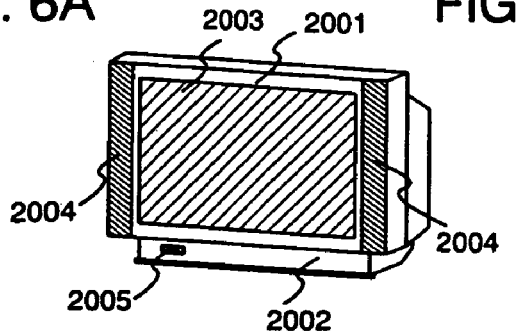
FIGS. 6A to 6H are diagrams showing electronic appliances to which the light emitting device of the present invention is applied.

FIG. 6A illustrates a light emitting device which includes a casing 2001, a support table 2002, a display portion 2003, a speaker portion 2004, a video input terminal 2005 and the like. The present invention is applicable to the display portion 2003. The light emitting device can be completed by employing the present invention. The light emitting device is of the self-emission-type and therefore requires no backlight. Thus, the display portion thereof can have a thickness thinner than that of the liquid crystal display device. The light emitting device includes the entire display device for displaying information, such as a personal computer, a receiver of TV broadcasting and an advertising display.

Figure 6B:
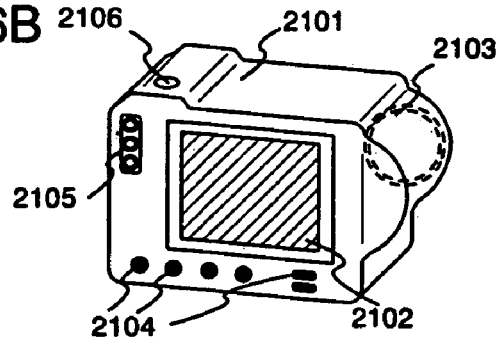

FIG. 6B illustrated a digital still camera which includes a main body 2101, a display portion 2102, an image receiving portion 2103, an operation key 2104, an external connection port 2105, a shutter 2106, and the like. The present invention is applicable to the display portion 2102. Further, the digital still camera as shown in FIG. 6B can be completed by employing the present invention.

Figure 6C:
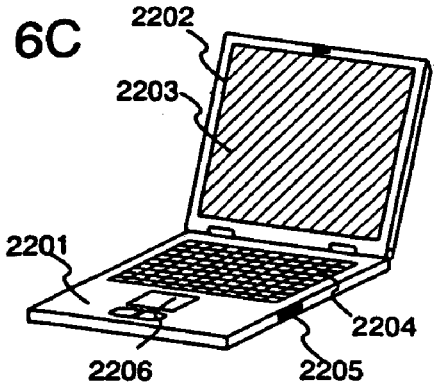

FIG. 6C illustrates a lap-top computer which includes a main body 2201, a casing 2202, a display portion 2203, a keyboard 2204, an external connection port 2205, a pointing mouse 2206, and the like. The present invention is applicable to the display portion 2203. Further, the lap-top computer as shown in FIG. 6C can be completed by employing the present invention.

Figure 6D:
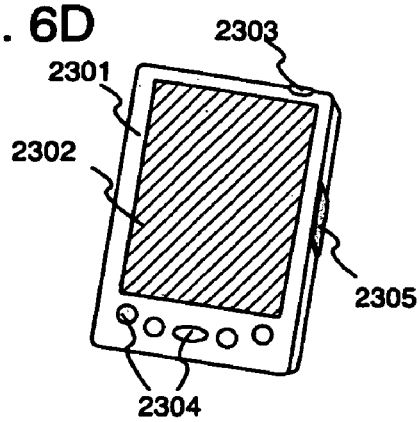

FIG. 6D illustrated a mobile computer which includes a main body 2301, a display portion 2302, a switch 2303, an operation key 2304, an infrared port 2305, and the like. The present invention is applicable to the display portion 2302. Further, the mobile computer as shown in FIG. 6D can be completed by employing the present invention.

Figure 6E:
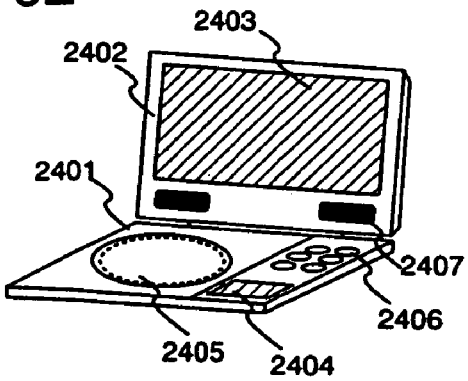

FIG. 6E illustrates a portable image reproduction apparatus including a recording medium (more specifically, a DVD reproduction apparatus), which includes a main body 2401, a casing 2402, a display portion A 2403, another display portion B 2404, a recording medium (DVD or the like) reading portion 2405, an operation key 2406, a speaker portion 2407 and the like. The display portion A 2403 is used mainly for displaying image information, while the display portion B 2404 is used mainly for displaying character information. The present invention is applicable to these display portions A 2403 and B 2404. The image reproduction apparatus including a recording medium further includes a game machine or the like. Further, the image displaying device as shown in FIG. 6E can be completed by employing the present invention.

Figure 6F:
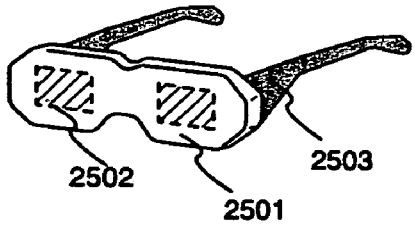

FIG. 6F illustrates a goggle type display (head mounted display) which includes a main body 2501, a display portion 2502, arm portion 2503, and the like. The present invention is applicable to the display portion 2502. Further, the goggle type display as shown in FIG. 6F can be completed by employing the present invention.

Figure 6G:
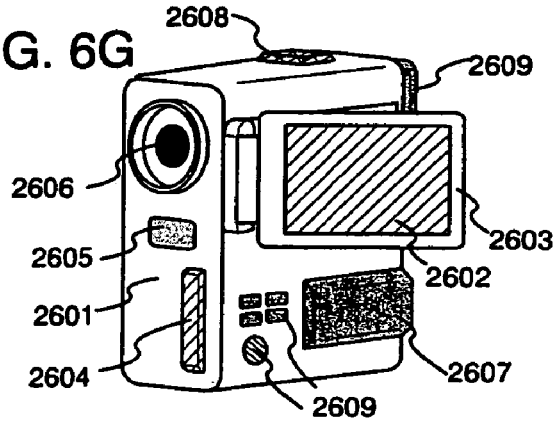

FIG. 6G illustrates a video camera which includes a main body 2601, a display portion 2602, a casing 2603, an external connecting port 2604, a remote control receiving portion 2605, an image receiving portion 2606, a battery 2607, a sound input portion 2608, an operation key 2609, an eyepiece portion 2610 and the like. The present invention is applicable to the display portion 2602. Further, the video camera as shown in FIG. 6G can be completed by employing the present invention.

Figure 6H:
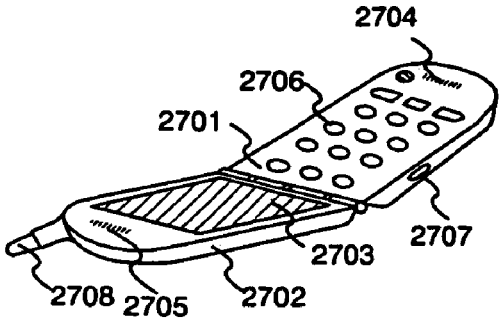
Figure 7A:
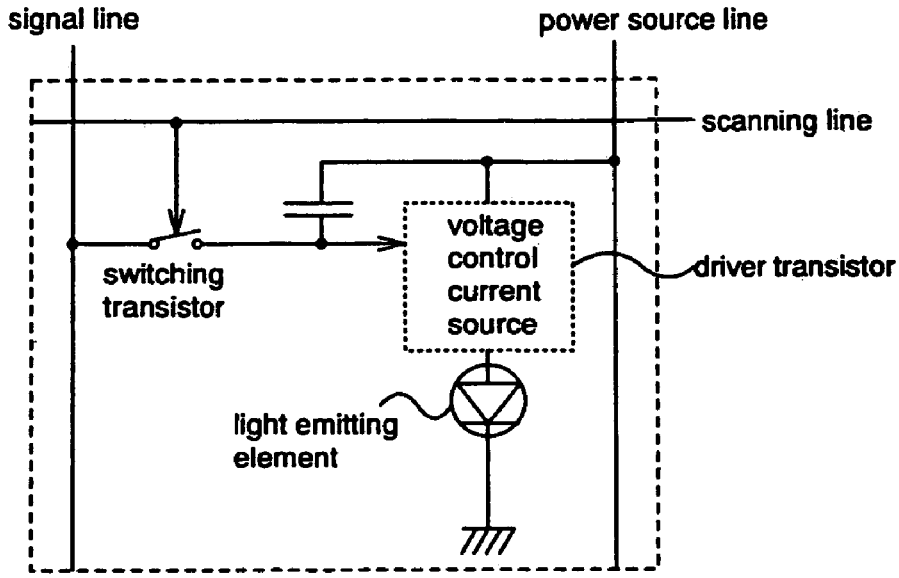
FIGS. 7A and 7B are concept diagrams of constant current drive and constant voltage drive.
Figure 7B:
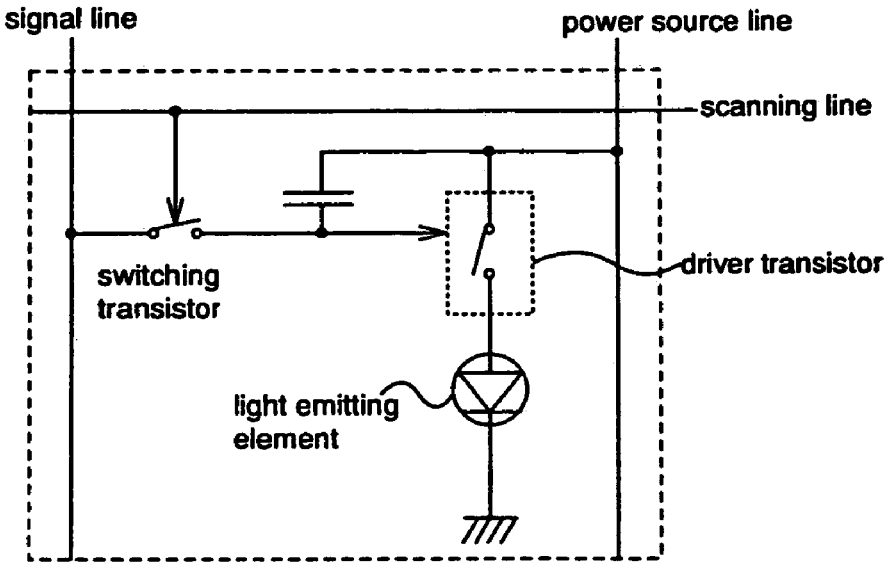
Figure 8A:
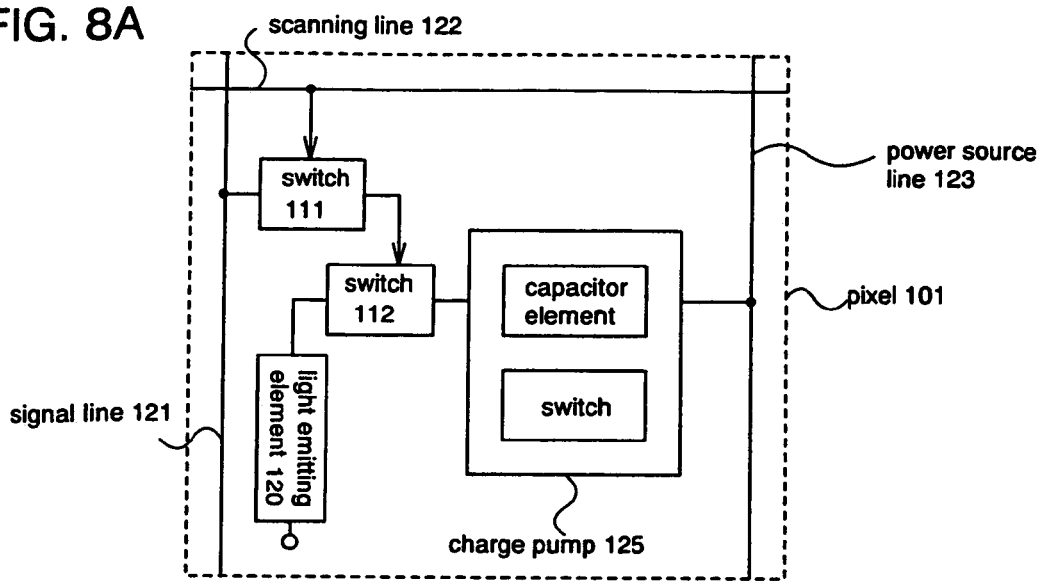
FIGS. 8A to 8C are diagrams showing a configuration of a pixel provided in the light emitting device of the present invention.
Figure 8B:
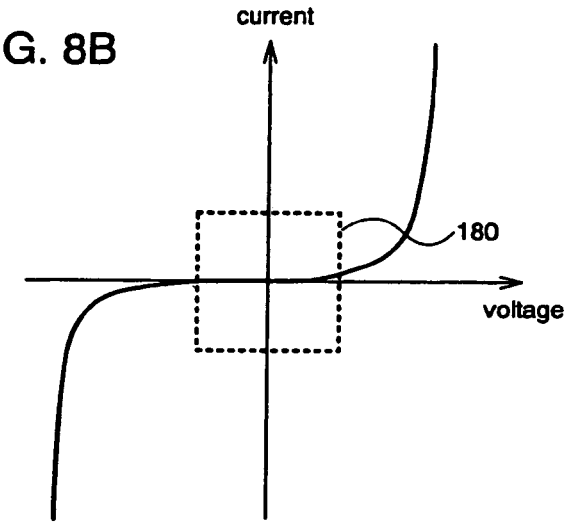
Figure 8C:
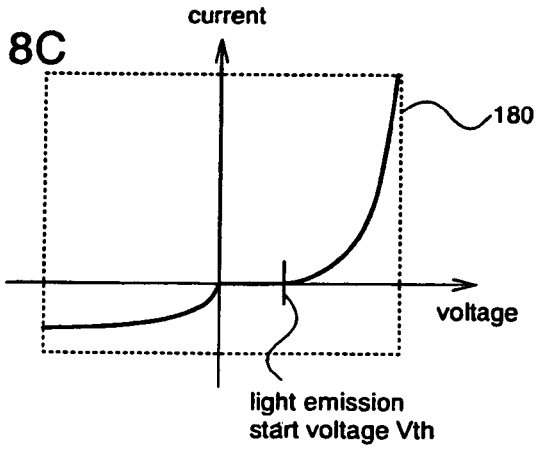

FIG. 6H illustrates a mobile telephone which includes a main body 2701, a casing 2702, a display portion 2703, a sound input portion 2704, a sound output portion 2705, an operation key 2706, an external connecting port 2707, an antenna 2708, and the like. The present invention is applicable to the display portion 2703. Note that the display portion 2703 can reduce power consumption of the mobile telephone by displaying white-colored characters on a black-colored background. Further, the mobile telephone as shown in FIG. 6H can be completed by employing the present invention.

When the brighter luminance of light emitted from the organic light-emitting material becomes available in the future, the light emitting device in accordance with the present invention will be applicable to a front-type or rear-type projector in which light including output image information is enlarged by means of lenses or the like to be projected.

The aforementioned electronic devices are more likely to be used for display information distributed through a telecommunication path such as Internet, a CATV (cable television system), and in particular likely to display moving picture information. The light emitting device is suitable for displaying moving pictures since the organic light-emitting material can exhibit high response speed.

A portion of the light emitting device that is emitting light consumes power, so it is desirable to display information in such a manner that the light-emitting portion therein becomes as small as possible. Accordingly, when the light emitting device is applied to a display portion which mainly displays character information, e.g., a display portion of a portable information terminal, and more particular, a mobile telephone or a sound reproduction device, it is desirable to drive the light emitting device so that the character information is formed by a light-emitting portion while a non-emission portion corresponds to the background.

As set forth above, the present invention can be applied variously to a wide range of electronic devices in all fields. The electronic devices in this embodiment can be obtained by utilizing a light emitting device having the configuration in which the structures in Embodiments 1 through 5 are freely combined.

According to the present invention, in order to suppress the influence of deterioration of a light emitting element resulting from a change over time, a light emitting device in which an electrical circuit for flowing a constant charge between both electrodes of the light emitting element is provided in each pixel can be provided. In addition, according to the present invention, a light emitting device in which a transistor provided in each pixel is operated in a linear region and used as only a switch, so that the light emitting device is not influenced by a variation in characteristic of the transistor can be provided.

Further, according to the present invention, because the transistor provided in each pixel is used as a switch, its conductivity type is not particularly limited. Thus, each pixel can be composed of transistors with a single polarity, thereby reducing the number of manufacturing steps. As a result, a yield in the manufacturing process can be improved to reduce a manufacturing cost.

What is claimed is:

1. A mobile telephone having a display device, the display device comprising:

a plurality of pixels, each of the plurality of pixels comprising:

a power source line;

a first switch, a second switch and a third switch;

a capacitor element having a pair of electrodes; and a light emitting element, wherein the power source line, the first switch, the second switch, the third switch and the light emitting element are electrically connected in series, and wherein one of the pair of electrodes of the capacitor element is electrically connected between the first switch and the second switch.

2. A mobile telephone according to claim 1, wherein the other one of the pair of electrodes of the capacitor element is at a ground state.

3. A mobile telephone according to claim 1, wherein the first switch, the second switch and the third switch comprise thin film transistors having a same conductivity type.

4. A mobile telephone according to claim 1, wherein the first switch is connected to the power source line.

5. A mobile telephone according to claim 1, wherein the third switch controls an electrical connection or no electrical connection between the light emitting element and the capacitor element.

6. A camera having a display device, the display device comprising:

a plurality of pixels, each of the plurality of pixels comprising:

a power source line;

a first switch, a second switch and a third switch;

a capacitor element having a pair of electrodes; and a light emitting element, wherein the power source line, the first switch, the second switch, the third switch and the light emitting element are electrically connected in series, and wherein one of the pair of electrodes of the capacitor element is electrically connected between the first switch and the second switch.

7. A camera according to claim 6, wherein the other one of the pair of electrodes of the capacitor element is at a ground state.

8. A camera according to claim 6, wherein the first switch, the second switch and the third switch comprise thin film transistors having a same conductivity type.

9. A camera according to claim 6, wherein the first switch is connected to the power source line.

10. A camera according to claim 6, wherein the third switch controls an electrical connection or no electrical connection between the light emitting element and the capacitor element.

11. A camera according to claim 6, wherein the camera is at least one of a digital camera and a video camera.

12. A personal computer having a display device, the display device comprising:

a plurality of pixels, each of the plurality of pixels comprising:

a power source line;

a first switch, a second switch and a third switch;

a capacitor element having a pair of electrodes; and a light emitting element, wherein the power source line, the first switch, the second switch, the third switch and the light emitting element are electrically connected in series, and wherein one of the pair of electrodes of the capacitor element is electrically connected between the first switch and the second switch.

13. A personal computer according to claim 12, wherein the other one of the pair of electrodes of the capacitor element is at a ground state.

14. A personal computer according to claim 12, wherein the first switch, the second switch and the third switch comprise thin film transistors having a same conductivity type.

15. A personal computer according to claim 12, wherein the first switch is connected to the power source line.

16. A personal computer according to claim 12, wherein the third switch controls an electrical connection or no electrical connection between the light emitting element and the capacitor element.

17. An image reproduction apparatus having a display device, the display device comprising:

a plurality of pixels, each of the plurality of pixels comprising:

a power source line;

a first switch, a second switch and a third switch;

a capacitor element having a pair of electrodes; and a light emitting element, wherein the power source line, the first switch, the second switch, the third switch and the light emitting element are electrically connected in series, and wherein one of the pair of electrodes of the capacitor element is electrically connected between the first switch and the second switch.

18. An image reproduction apparatus according to claim 17, wherein the other one of the pair of electrodes of the capacitor element is at a ground state.

19. An image reproduction apparatus according to claim 17, wherein the first switch, the second switch and the third switch comprise thin film transistors having a same conductivity type.

20. An image reproduction apparatus according to claim 17, wherein the first switch is connected to the power source line.

21. An image reproduction apparatus according to claim 17, wherein the third switch controls an electrical connection or no electrical connection between the light emitting element and the capacitor element.

22. A goggle type display having a display device, the display device comprising:

a plurality of pixels, each of the plurality of pixels comprising:

a power source line;

a first switch, a second switch and a third switch;

a capacitor element having a pair of electrodes; and a light emitting element, wherein the power source line, the first switch, the second switch, the third switch and the light emitting element are electrically connected in series, and wherein one of the pair of electrodes of the capacitor element is electrically connected between the first switch and the second switch.

23. A goggle type display according to claim 22, wherein the other one of the pair of electrodes of the capacitor element is at a ground state.

24. A goggle type display according to claim 22, wherein the first switch, the second switch and the third switch comprise thin film transistors having a same conductivity type.

25. A goggle type display according to claim 22, wherein the first switch is connected to the power source line.

26. A goggle type display according to claim 22, wherein the third switch controls an electrical connection or no electrical connection between the light emitting element and the capacitor element.

27. A device comprising:

a plurality of pixels, each of the plurality of pixels comprising:

a line;

a first switch, a second switch and a third switch;

a capacitor element having a pair of electrodes; and a pixel electrode, wherein the line, the first switch, the second switch, the third switch and the pixel electrode are electrically connected in series, and wherein one of the pair of electrodes of the capacitor element is electrically connected between the first switch and the second switch.

28. A device according to claim 27, wherein the other one of the pair of electrodes of the capacitor element is at a ground state.

29. A device according to claim 27, wherein the first switch, the second switch and the third switch comprise thin film transistors having a same conductivity type.

30. A device according to claim 27, wherein the first switch is connected to the line.

31. A device according to claim 27, wherein the third switch controls an electrical connection or no electrical connection between the pixel electrode and the capacitor element.

32. A device according to claim 27, wherein the line is a power source line.

* * * * *